US008001738B2

(12) United States Patent
Ting

(10) Patent No.: US 8,001,738 B2
(45) Date of Patent: Aug. 23, 2011

(54) AIRLOOP WINDOW WALL SYSTEM

(76) Inventor: Raymond M. L. Ting, Pittsburgh, PA (US)

( * ) Notice: Subject to any disclaimer, the term of this patent is extended or adjusted under 35 U.S.C. 154(b) by 372 days.

(21) Appl. No.: 12/369,984

(22) Filed: Feb. 12, 2009

(65) Prior Publication Data

US 2009/0199498 A1 Aug. 13, 2009

Related U.S. Application Data

(60) Provisional application No. 61/028,042, filed on Feb. 12, 2008, provisional application No. 61/044,815, filed on Apr. 14, 2008.

(51) Int. Cl.
*E06B 7/02* (2006.01)
*E06B 7/10* (2006.01)
*E04H 1/00* (2006.01)

(52) U.S. Cl. ..... 52/235; 52/204.593; 52/204.597; 52/204.6

(58) Field of Classification Search ..... 52/235, 52/210–213, 220.1–220.8, 204.53, 204.54, 52/204.56, 204.57, 204.591, 204.593, 204.595, 52/204.597, 204.6, 204.61, 204.71, 204.62, 52/204.68

See application file for complete search history.

(56) References Cited

U.S. PATENT DOCUMENTS

| | | | | | |
|---|---|---|---|---|---|
| 2,559,871 | A * | 7/1951 | Gay | 237/1 R |
| 3,415,024 | A * | 12/1968 | Kotlarz | 52/220.2 |
| 3,439,601 | A * | 4/1969 | Cooper | 454/198 |
| 4,103,598 | A * | 8/1978 | Cooper | 454/186 |
| 4,918,897 | A * | 4/1990 | Luedtke | 52/742.14 |
| 5,048,257 | A * | 9/1991 | Luedtke | 52/747.1 |
| 5,154,029 | A * | 10/1992 | Sturgeon | 52/235 |
| 5,253,459 | A * | 10/1993 | Parinas et al. | 52/235 |
| 5,267,419 | A * | 12/1993 | Yokota et al. | 52/235 |
| 5,309,689 | A * | 5/1994 | Croissant | 52/235 |
| 5,822,935 | A * | 10/1998 | Mitchell et al. | 52/239 |
| 7,832,160 | B2 * | 11/2010 | Farag | 52/235 |
| 2002/0148178 | A1 * | 10/2002 | Farag | 52/204.1 |

* cited by examiner

*Primary Examiner* — Jeanette E. Chapman
(74) *Attorney, Agent, or Firm* — Rosenberg, Klein & Lee

(57) ABSTRACT

An airloop wall system with durable water-tightness performance is disclosed. The system comprises a base anchor member secured to a top surface of a first floor slab, a base track connected to the base anchor, a base flashing for repelling moisture, a first ceiling anchor member secured to a bottom surface of the first floor slab, a first ceiling track connected to the first ceiling anchor member, a slab edge panel attached to the base track and the first ceiling track, a second ceiling anchor member secured to a bottom surface of a second floor slab, a second ceiling track connected to the second ceiling anchor member, a panel sill frame attached to the base track, a panel head frame attached to the second ceiling track, two jamb frames, and a panel secured between the frames. Corners of the frames are miter-matched such that air spaces inside form an airloop.

32 Claims, 5 Drawing Sheets

AIRLOOP WINDOW WALL SYSTEM

REFERENCE TO RELATED APPLICATIONS

This Utility Patent Application is based on Provisional Patent Application Ser. No. 61/028,042 filed 12 Feb. 2008, and Provisional Patent Application Ser. No. 61/044,815, filed 14 Apr. 2008.

FIELD OF THE INVENTION

This invention relates to exterior wall systems inserted between two adjacent floors known as window wall, specifically an improvement on the performances of the wall systems by the application of Airloop Principle as described by Ting in U.S. Pat. Nos. 5,452,552 and 5,598,671. The structure disclosed in U.S. Pat. No. 5,452,552 is also known as an exposed frame Airloop curtain wall system and the structure disclosed in U.S. Pat. No. 5,598,671 is also known as a hidden frame Airloop curtain wall system.

BACKGROUND OF THE INVENTION

A window wall system which in general, spans from the top surface of a floor to the underside of the floor above or to the bottom edge of a spandrel masonry or concrete panel above. Most of the window wall systems in the market include four types of wall components, namely, (1) a bottom sealing and anchoring member, (2) a top sealing and anchoring member, (3) shop prefabricated panel units installed between the bottom and the top anchoring members, and (4) an exterior floor slab cover. The parameters for a successful window wall project include durable weather shield, durable structural safety, ability to adjust for construction tolerances of the wall anchoring surface, easiness of erection, and no need for exterior access or lifting equipment. Any improvement on these parameters would represent an advance in the window wall technology. In addition, the ability to maintain a curtain wall type of flush exterior appearance is highly desirable but rather difficult since the window wall must be supported on the floor while the water infiltrated into the wall panel joints must be drained to the exterior of the slab edge making it become necessary for the slab edge cover to be protruded from the face of the window wall. Through years of experiences, the major areas needing further improvement are described as follows:

(1) Water-tightness Performance: All conventional window wall systems require perfect sealing property at some critical sealing locations to maintain water-tightness performance. Experience indicated that the durability of the perfect sealing property at the critical seal locations is grossly inadequate due to workmanship and material degradation problems as well as stress fatigue due to various structural movements.

(2) The erected window wall is expected to be plumb and leveled at the design position. However, a ±¾" (19 mm) variation in the finished floor level as well as the floor edge location are normally considered as acceptable in the building industry. In installing each piece of the top or the bottom anchoring member in a conventional window wall system, shims as required are used to adjust it to the design location. These anchoring members are continuous along the foot print of the window wall and they can be field cut to fit at a wall terminating end or at a wall corner, there is no need for the positioning adjustment in the left-to-right direction. Thus, before the anchoring screws can be applied, the anchoring member must be adjusted to both the true in-and-out position and the true up-and-down position by using shims as required. The application of an anchoring screw requires two steps, namely pre-drilling the screw hole using a driller and applying the screw using a screw gun. In both steps of the screw application, the anchoring member is very easy to slide on top of the shims causing it to be out of position and the shims are very easy to shift out of position, therefore, it is a very time consuming process to achieve the required quality result. In addition, the structural strength of the anchoring screw would be reduced with a high shim condition. Even though a reduced screw strength can be theoretically compensated by a reduced screw spacing at the high shim locations, it can't be shown on the drawing since the high shim locations can't be predefined and it is totally impractical to execute in the field without a pre-engineering calculation. It is most likely to compromise the structural integrity of the erected window wall. Even though the required screw spacing can be conservatively engineered with the assumption of highest shim condition, it would significantly increase the cost.

(3) In a conventional window wall system, each panel has a male jamb member and a female jamb member. The panels are erected in a fixed direction by engaging the male jamb into the female jamb of the already installed panel or vise versa. Due to the directional erection requirement, project delays are commonly caused by inadequate coordination with other trades on the job.

(4) In a conventional window wall system, the exterior floor slab edge cover and some exterior perimeter caulking lines are normally applied from outside after the panel erection. This exterior access requirement has a significant impact on the erection cost especially in a congested inner city location.

(5) An exterior wall system known as a Hybrid System represents an attempt to utilize the advantage of a window wall system for being supported between two adjacent floors and the advantage of a curtain wall system for flush exterior wall surface appearance. Experiences indicated multiple difficulties with anchoring and construction tolerance problems due to the notched mullion with discrete anchoring locations.

Therefore there is need for an improved window wall system that overcomes the disadvantages of conventional wall systems.

SUMMARY OF THE INVENTION

To achieve these and other advantages and in order to overcome the disadvantages of the conventional systems in accordance with the purpose of the invention as embodied and broadly described herein, the present invention provides an airloop window wall system that does not require exterior access during construction.

Several objectives of the present invention include the following items.

1. To provide a window wall system with durable water-tightness performance.
2. To provide a window wall system to tolerate high degree of building construction tolerance with easy tolerance adjustment and without impairing the structural integrity of the anchoring system.
3. To provide a window wall system to allow for non-directional erection method.
4. To provide a window wall system to allow the use of completely interior access erection method.

5. To provide a window wall system having a flush exterior surface appearance of a typical curtain wall.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENT OF THE INVENTION

Figure 1:
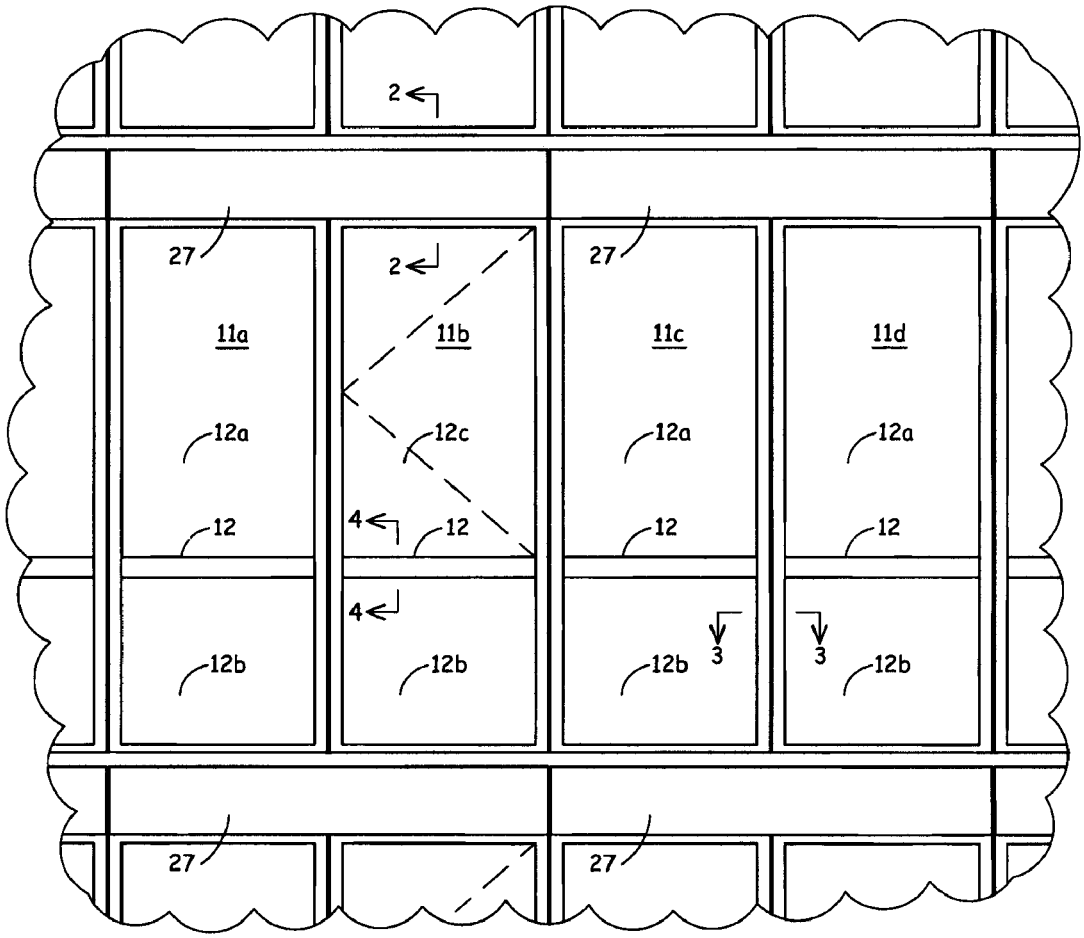
FIG. 1 is a typical partial elevation view of a window wall system incorporating an embodiment of the present invention.

Reference will now be made in detail to the preferred embodiments of the present invention, examples of which are illustrated in the accompanying drawings. Wherever possible, the same reference numbers are used in the drawings and the description to refer to the same or like parts.

In order to better explain the working principles of the invention, the following terminology will be used herein:

Window Wall Panel: one of a plurality of panels or panel assemblies having at least one building facing wall element secured and nominally sealed to a panel frame, typically a perimeter portion of the facing element is shop secured and sealed to segments of the panel frame;

Inner Airloop: an air space substantially forming a loop around and near the perimeter edges of the facing elements and generally within the panel frame; and Outer Airloop: an air space substantially forming a loop around and outside of the panel frame.

For clarity the following list of numeral references of the elements illustrated in the Figures is provided:

| Subject | Elements |
|---|---|
| Airloop window wall system | 10 |
| shop assembled window wall panels | 11a to 11d |
| horizontal intermediate stack member | 12 |
| insulated, dual glass segments | 12a, 12b, 12c |
| base anchor member | 13 |
| masonry fastener | 14 |
| ceiling anchor member | 15 |

-continued

| Subject | Elements |
|---|---|
| masonry anchor | 16 |
| base track member | 17, 17a |
| metal screw | 18 |
| ceiling track member | 19 |
| fasteners | 20 |
| sill frame | 21, 21a |
| metal screws | 22 |
| air seal | 23 |
| head frame | 24, 24a |
| air seal | 25 |
| base membrane | 26, 26a |
| slab edge panel | 27 |
| panel jamb frame | 28a, 28b |
| vertical joint member | 29 |
| air seal gasket | 30 |
| water seal gasket | 31 |
| rain deflecting gasket | 32 |
| air space under base track member | 33 |
| outer Airloop segments | 34a, 34b, 34c |
| inner Airloop segments | 35a, 35b, 35c |
| air space inside stack member | 35d |
| air holes | 36a to 36d |
| head retainer | 37 |
| base perimeter caulking | 38 |
| base trim | 39 |
| ceiling perimeter caulking | 40 |
| head trim | 41 |
| stack member | 42 |
| reveal joint | 43 |
| structural male lip on 17a | 44 |
| structural lip on 50 | 45 |
| reveal joint | 46 |
| rain screen leg on 24a | 47 |
| wipe gasket | 48 |
| recessed outer flange on 17a | 49 |
| recessed outer flange on 19a | 50 |

FIG. 1 illustrates an embodiment of the window wall system 10 comprising an assembly of multiple shop assembled window wall panels (e.g. panels 11*a* through 11*d*) that are installed between two adjacent floors near the floor slab edge. Although FIG. 1 shows an embodiment of a window wall system 10 in which the infill material of each window wall panel 11*a* through 11*d* is composed of insulated, fixed dual glass segments 12*a* and 12*b* as well as an operable window sash 12*c*, the window wall system can also comprise other solid materials as facing elements such as aluminum plate, stone, foam panel etc. or ventilating louver for A/C unit. Although the panels 11*a* through 11*d* shown are panels with exposed panel frames on all four sides, the panels can also have hidden panel frames on all four sides or any combinations of hidden and exposed panel frames. And although the panels 11*a* through 11*d* shown in FIG. 1 are generally square, substantially flat panel assemblies, other assembly shapes of panels may also be used. But however the individual panels are shaped, multiple panels must be joined together to cover the opening area between two adjacent floor slabs.

As shown, an optional horizontal intermediate stack member 12 in each panel separates the panel area into a top facing panel 12*a* or 12*c* and a bottom facing panel 12*b*. None or any number of horizontal intermediate stack members 12 can be used in any individual window wall panel. The stack member 12 can be oriented in the vertical or any inclined directions also.

Figure 2:
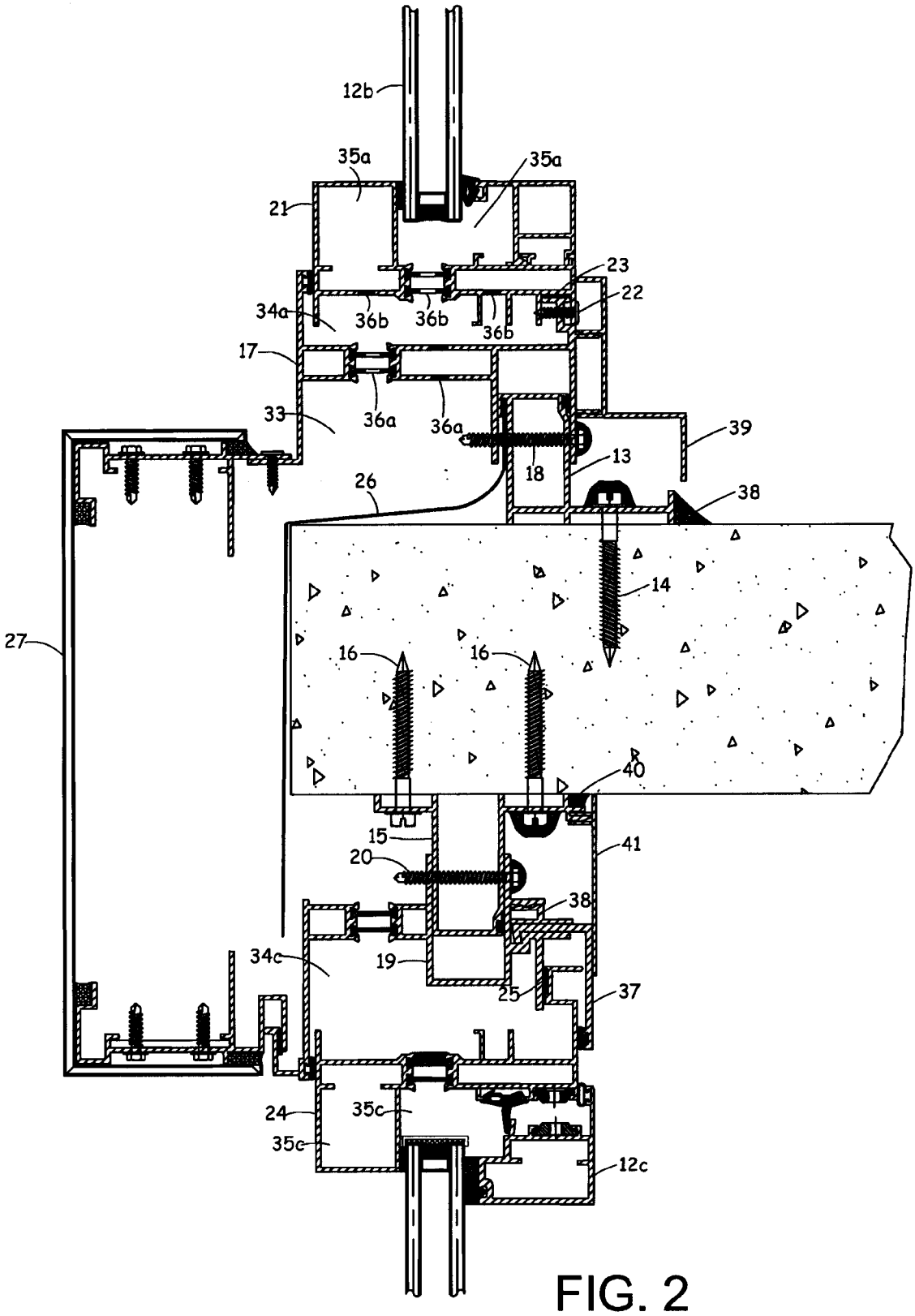
FIG. 2 is a partial cross-sectional view taken along line 2-2 of FIG. 1 showing a vertical cross-section of an embodiment of the present invention taken at the floor slab edge.

FIG. 2 shows a typical fragmentary cross-section taken along line 2-2 as shown in FIG. 1. The details include base details above the floor slab, ceiling details below the floor slab, and an exterior slab edge cover details. The following explanations consider the same ceiling details on the same floor of the base details. The erection of the window wall system can be separated into two major categories, namely the non-panel erection and the panel erection. The non-panel erection consists of the following five erection steps. The three dimensional positions of the window wall are defined by the following non-panel erection steps. (1) Position the base anchor member 13 at the true in-and-out position along the foot print of the wall. Without any adjustment for the true up-and-down position, secure the base anchor member 13 to the floor surface following the contour of the slab surface using masonry fastener 14. This singular directional adjustment of member 13 with direct contacting surface on the floor is very easy to maintain the position of member 13 during the application of the fastener 14. Only small shim (not shown) is required occasionally to correct the tilting of member 13 in the in-and-out direction, therefore, the structural integrity of the masonry fastener 14 is ensured. Then, install the base membrane 26 to prevent the wetting of the slab edge and to act as the base drain flashing. Even though rigid metal base flashing can be used for 26, membrane material is preferred due to its ability to follow any irregular edge conditions of the floor slab. (2) Engage the base track 17 with the base anchor member 13 and adjust it to the true up-and-down position, then, secure the base track 17 in position using the metal screws 18. It can be seen that this singular positioning adjustment of the base track 17 can be done very easily due to the tight engagement with the base anchor member 13. (3) Secure the ceiling anchor member 15 along the window wall line to the underside of the floor slab surface following the contour of the slab surface using masonry fastener 16. Similar to the above discussions, the structural integrity of the masonry fastener 16 is ensured. (4) Engage the ceiling track 19 to the ceiling anchor member 15 and adjust it to the true up-and-down position, then, secure to member 15 using metal screws 20. It can be seen that this singular positioning adjustment of the ceiling track 19 can be done very easily due to the tight engagement with the ceiling anchor member 15. Once the base track 17 and the ceiling track 19 are installed, the theoretical window wall positions in all directions (vertical, in-and-out, left-to-right) are defined. Combining the explanations of the above four steps, the floor slab construction tolerance can be easily adjusted without impairing the structural integrity of the anchoring fastener, The Objective No. 2 of the invention is achieved. (5) Install the decorative slab edge panels 27. The above five steps constitute the non-panel erection. Upon the completion of the panel erection, as shown, a typical panel sill frame 21 with a fixed glass 12*b* is structurally engaged with the base track 17 and secured in position by fastener 22 and air seal 23 is provided in between. Also as shown, a typical panel head frame 24 with an operable window sash 12*c* is caused to have structural contact with the ceiling track 19 and air seal 25 is provided in between.

Figure 2A:
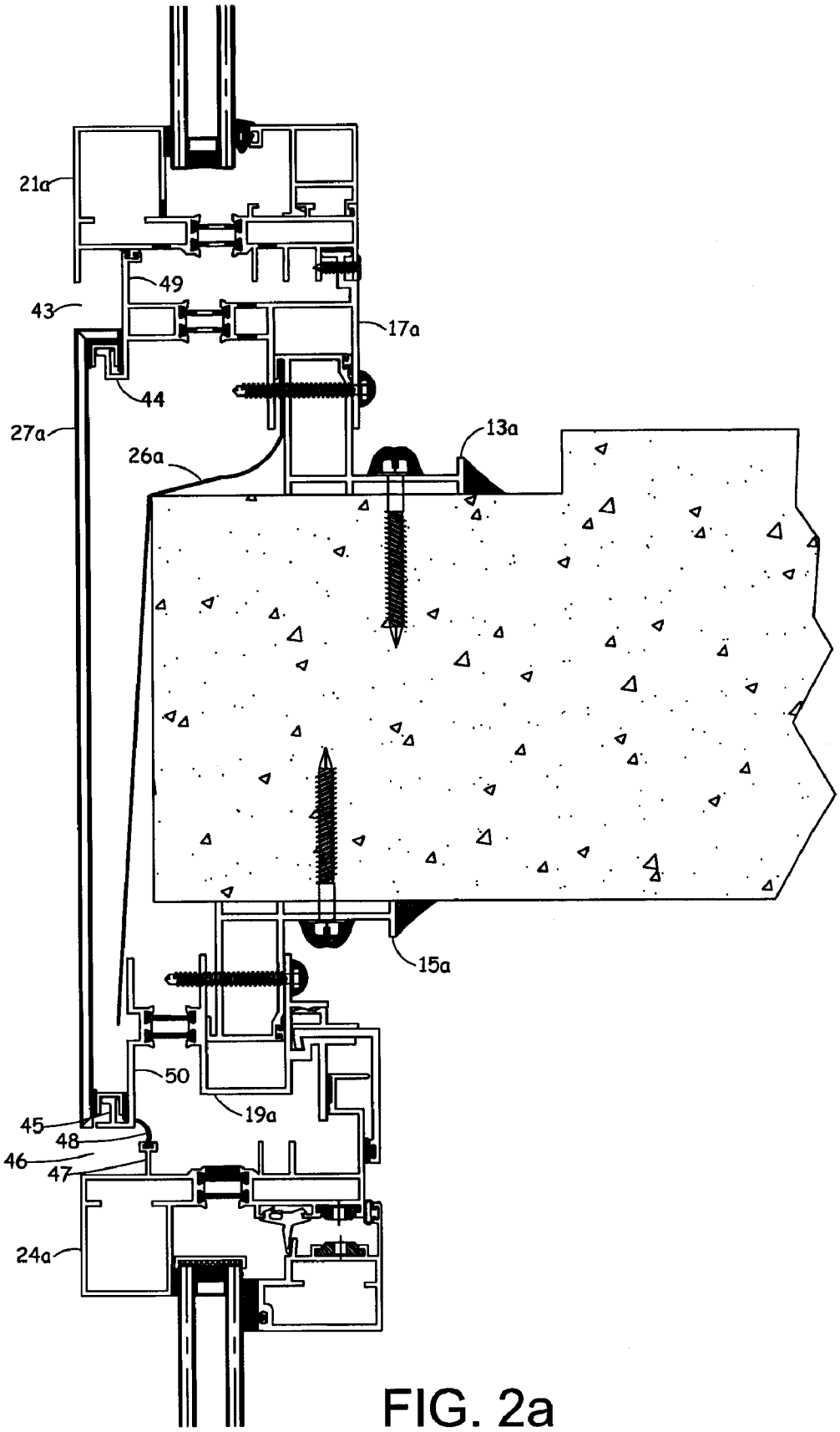
FIG. 2*a* is an alternative detail of FIG. 2 showing a flush exterior wall surface of a curtain wall system.

FIG. 2*a* shows alternative details of FIG. 2 with flush exterior wall surface over the slab edge area. To make this design possible, the exterior wall line must be protruded outwardly beyond the slab edge for a distance to allow adequate room for construction tolerance adjustment and the depth of the slab edge cover panel. To fulfill the above requirement, the exterior face of the base anchor member 13*a* and the ceiling anchor member 15*a* must be significantly off-set inwardly from the exterior wall line such that the base anchor member and the ceiling anchor member can maintain a firm contact with the slab top and bottom surfaces respectively as shown. The base track 17*a* has a recessed outer flange 49 to create a reveal joint 43 between the slab edge cover panel 27*a* and the sill frame 21*a* of the panel unit above. A structural male lip 44 is provided at the bottom of the outer flange 49 to cause engagement with the slab edge cover panel 27*a*. Similarly, the ceiling track 19*a* has a recessed outer flange 50 to create a reveal joint 46 between the slab edge cover panel 27*a* and the head frame 24*a* of the panel unit below. A structural male lip 45 is provided at the bottom of the outer flange 50 to cause engagement with the slab edge cover panel 27*a*. As shown, upon the engagement of the slab edge cover panel, 27*a*, a flush exterior wall surface is achieved. The Objective No. 5 of the current invention is achieved. By adjusting the depth of base/ceiling track members 17*a*, 19*a* and/or the depth of the slab edge cover panel 27*a*, either a protruding or recessed slab edge cover can be accomplished by this design. In conjunction with this design, a recessed rain screen leg, 47 and a wipe gasket 48 on top of 47 are provided in the head frame 24*a*. It can be seen that the water draining down between the membrane 26*a* and the unsealed cover panel 27*a* will be directed to the outside in front of the rain screen leg 47, therefore, effective water drainage is accomplished on each individual floor. In case of a steel frame building with spandrel beam near the slab edge, a slab edge extension under the floor slab can be installed to cover the depth of the spandrel beam and the same design can be used by simply considering the combined depth of the floor slab and the slab edge extension as the depth of the slab edge for the design of the slab edge cover panel.

Figure 3:
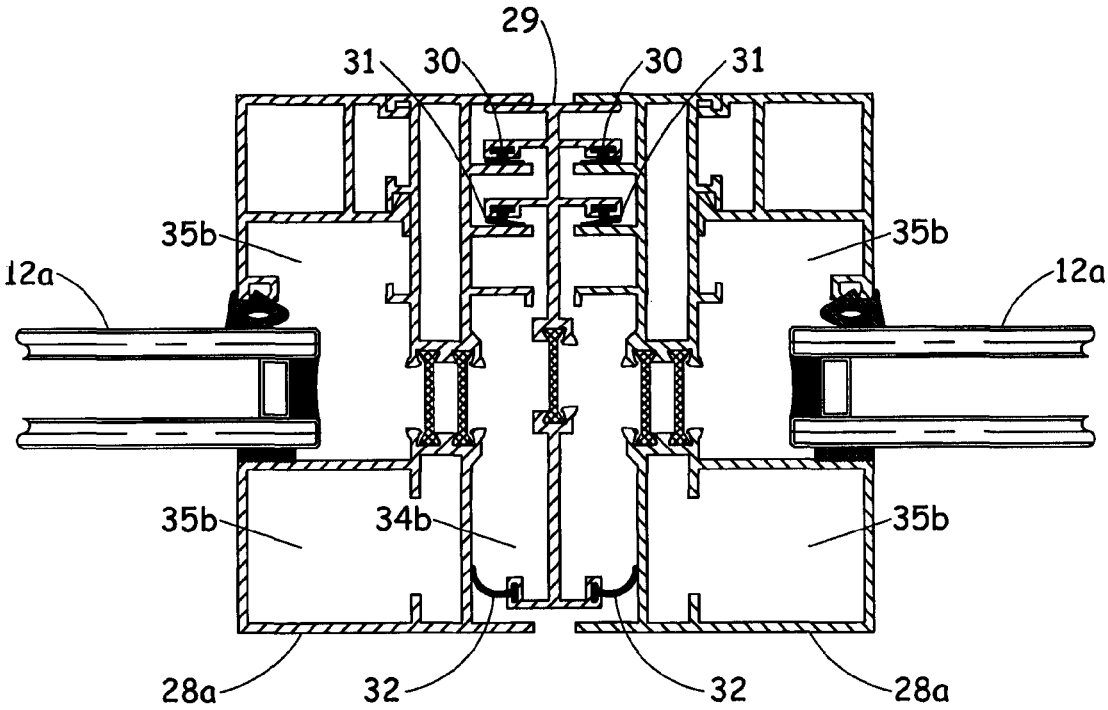
FIG. 3 is a partial horizontal cross-sectional view taken along line 3-3 of FIG. 1 showing a vertical panel joint of an embodiment of the present invention.

FIG. 3 shows a typical fragmentary cross-section of a panel vertical joint of this invention taken along line 3-3 of FIG. 1. The right jamb frame 28*a* of the panel 11*c* (shown on FIG. 1) and the left jamb frame 28*b* of the panel 11*d* are joined by an independent vertical joint member 29 and air seal gaskets 30, water seal gaskets 31, and rain deflecting gaskets 32 are provided to seal the joint.

Reviewing FIGS. 1 to 3 simultaneously, the implementation of Airloop Principle is explained as follows. Each panel consists of a sill frame 21, a head frame 24 and two jamb frames 28*a* and 28*b*. The frame corners are miter-matched such that the air spaces 35*a*, 35*b*, and 35*c* are inter-connected to form the Inner Airloop. The air spaces 34*a*, 34*b*, and 34*c* are inter-connected to form the Outer Airloop. The air space 33 is subjected to the exterior air pressure. The Outer Airloop consisting of 34*a*, 34*b*, and 34*c* is pressure equalized to the air space 33 through air holes 36*a*. The Inner Airloop consisting of 35*a*, 35*b*, and 35*c* is pressure equalized to the Outer Airloop through air holes 36*b*. The pressure equalized Inner and Outer Airloops are formed to achieve durable water-tightness performance as explained in the cited Ting Patents. The Objective No. 1 of this invention is achieved.

Reviewing FIGS. 1 to 3 simultaneously, the panel erection is explained in the following steps by standing on the floor from the interior side: (1) Engage the vertical joint member into the jamb of the panel already secured in position; (2) Tilt the top of the panel to be erected inwardly and slightly away from the vertical joint member 29 and drop the panel into bottom engagement with the base track 17 and due to the dead weight moment, the top of the panel will automatically swing outwardly to cause contact with the ceiling track 19; (3) Slide the panel laterally to cause panel jamb engagement with the vertical joint member 29. As shown, there is room for adjusting the joint gap to take care of panel dimensional tolerance; (4) After multiple panels have been secured in position, drop in the head retainer 37 to provide structural support against positive wind load and snap in the spaced apart clips 38 to prevent the rotation of the head retainer 37; (5) Apply the base perimeter caulking 38 and snap on the base trim 39; (6) Apply the ceiling perimeter caulking 40 and snap on the head trim 41. Due to the use of independent vertical joint member 29 in combination of joint width adjustability, the panels can be erected from either from left-to-right or right-to-left and there is no problem for the process of leave-out-and-back-fill (i.e. non-directional erection method). Thus, the Objective No. 3 of this invention is achieved. The non-panel erection steps explained previously and the panel erection steps explained herein can all be easily done without exterior access, therefore, the Objective No. 4 of this invention is achieved.

Figure 4:
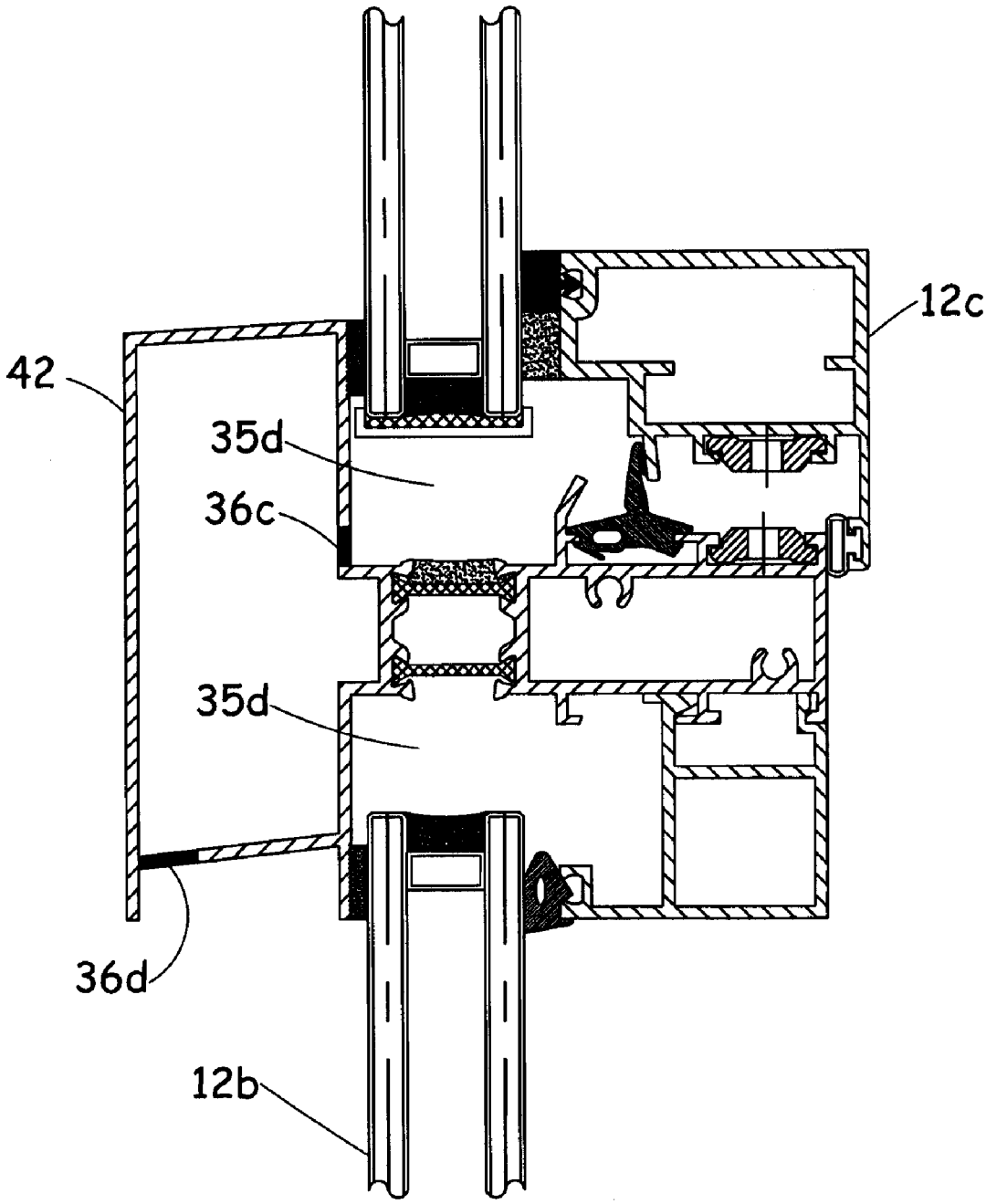
FIG. 4 is a partial vertical cross-sectional view taken along line 4-4 of FIG. 1 showing the cross-section at a horizontal stack member of an embodiment of the present invention.

FIG. 4 shows a typical fragmentary cross-section of an optional horizontal panel stack member 42 of this invention taken along line 4-4 of FIG. 1. As shown, the stack member 42 supports the operable window sash 12*c* on the top and a fixed glass at the bottom. The stack member 42 is fastened at the ends to the jamb frames 28*a* and 28*b* of the same panel. However, the ends of 42 are not completely sealed to 28*a* and 28*b* to allow the air space 35*d* to be connected to air space 35*b* to pressure equalize the air space 35*d*. The additional air holes 36*c* and 36*d* will serve to drain any water sipped into the air space 35*d*.

It is preferable to use extrudable materials for making the panel frame and perimeter frame members such as aluminum or PVC. At the sealing locations where relative displacement between the sealing components is expected, a contact type of sealant material such as gasket or foamed sealing tape is preferred.

Although preferred embodiments of the invention have been described in detail herein and illustrated in the accompanying drawings, it is to be understood that the invention is not limited to these precise embodiments and that various changes and modifications may be effected therein without departing from the scope or spirit of the invention.

What is claimed is:

1. An airloop wall system with durable water-tightness performance for installing on a floor surface and a ceiling surface of a floor slab comprising:

a base anchor member secured to the floor surface of the floor slab;

a base track connected to the base anchor member;

a base flashing secured between the base anchor and the base track and extending over an edge of the floor slab for preventing moisture from wetting an edge of the floor slab;

a ceiling anchor member secured to the ceiling surface of the floor slab;

a ceiling track connected to the ceiling anchor member; and a slab edge panel attached to the base track and the ceiling track;

wherein the base track and the ceiling track enable directional positioning adjustment to tolerate construction tolerances.

2. The airloop wall system of claim 1, wherein the base anchor member is secured to the floor surface of the floor slab using masonry fasteners.

3. The airloop wall system of claim 1, wherein the base track is connected to the base anchor member using metal screws.

4. The airloop wall system of claim 1, wherein the base flashing comprises a pliable waterproof material or a metal material.

5. The airloop wall system of claim 1, wherein the ceiling anchor member is secured to the ceiling surface of the floor slab using masonry fasteners.

6. The airloop wall system of claim 1, wherein the ceiling track is connected to the ceiling anchor member using metal screws.

7. The airloop wall system of claim 1, wherein the airloop window wall system provides a flush exterior surface appearance of a typical curtain wall.

8. The airloop wall system of claim 1, wherein erection of the airloop window wall system requires only interior access.

9. An airloop wall system with durable water-tightness performance comprising:

a first base anchor member secured to a top surface of a first floor slab;

a first base track connected to the first base anchor member;

a base flashing secured between the first base anchor and the first base track and extending over an edge of the first floor slab for preventing moisture from wetting an edge of the first floor slab;

a first ceiling anchor member secured to a bottom surface of the first floor slab;

a first ceiling track connected to the first ceiling anchor member;

a slab edge panel attached to the first base track and the first ceiling track;

a second ceiling anchor member secured to a bottom surface of a second floor slab above the first floor slab;

a second ceiling track connected to the second ceiling anchor member;

a panel sill frame attached to the first base track;

a panel head frame attached to the second ceiling track;

a first jamb frame;

a second jamb frame; and a panel secured between the panel sill frame, the panel head frame, the first jamb frame, and the second jamb frame;

wherein frame corners of the panel sill frame, the panel head frame, the first jamb frame, and the second jamb frame are miter-matched such that air spaces inside the panel sill frame, the panel head frame, the first jamb frame, and the second jamb frame are interconnected to form an airloop.

10. The airloop wall system of claim 9, wherein the first base anchor member is secured to the top surface of the first floor slab using masonry fasteners.

11. The airloop wall system of claim 9, wherein the first base track is connected to the first base anchor member using metal screws.

12. The airloop wall system of claim 9, wherein the base flashing comprises pliable waterproof material or metal material.

13. The airloop wall system of claim 9, wherein the first ceiling anchor member is secured to the bottom surface of the first floor slab using masonry fasteners.

14. The airloop wall system of claim 9, wherein the first ceiling track is connected to the first ceiling anchor member using metal screws.

15. The airloop wall system of claim 9, wherein the second ceiling anchor member is secured to the bottom surface of the second floor slab using masonry fasteners.

16. The airloop wall system of claim 9, wherein the second ceiling track is connected to the second ceiling anchor member using metal screws.

17. The airloop wall system of claim 9, wherein the base track and the ceiling track enable directional positioning adjustment to tolerate construction tolerances.

18. The airloop wall system of claim 9, wherein the airloop window wall system provides a flush exterior surface appearance of a typical curtain wall.

19. The airloop wall system of claim 9, wherein erection of the airloop window wall system requires only interior access.

20. The airloop wall system of claim 9, wherein the panel comprises glass, aluminum plate, stone, foam, operable window sash, or ventilating louver.

21. An airloop wall system with durable water-tightness performance comprising:

a first base anchor member secured to a top surface of a first floor slab;

a first base track connected to the first base anchor member;

a base flashing secured between the first base anchor and the first base track and extending over an edge of the first floor slab for preventing moisture from wetting an edge of the first floor slab;

a first ceiling anchor member secured to a bottom surface of the first floor slab;

a first ceiling track connected to the first ceiling anchor member;

a slab edge panel attached to the first base track and the first ceiling track;

a second ceiling anchor member secured to a bottom surface of a second floor slab above the first floor slab;

a second ceiling track connected to the second ceiling anchor member;

a panel sill frame attached to the first base track;

a panel head frame attached to the second ceiling track;

a first jamb frame;

a second jamb frame;

a vertical joint member;

a first panel secured between the panel sill frame, the panel head frame, the first jamb frame, and the vertical joint member; and a second panel secured between the panel sill frame, the panel head frame, the second jamb frame, and the vertical joint member;

wherein frame corners of the panel sill frame, the panel head frame, the first jamb frame, and the second jamb frame are miter-matched such that air spaces inside the panel sill frame, the panel head frame, the first jamb frame, and the second jamb frame are interconnected to form an inner airloop and an outer airloop.

22. The airloop wall system of claim 21, wherein the first base anchor member is secured to the top surface of the first floor slab using masonry fasteners.

23. The airloop wall system of claim 21, wherein the first base track is connected to the first base anchor member using metal screws.

24. The airloop wall system of claim 21, wherein the base flashing comprises pliable waterproof material or metal material.

25. The airloop wall system of claim 21, wherein the first ceiling anchor member is secured to the bottom surface of the first floor slab using masonry fasteners.

26. The airloop wall system of claim 21, wherein the first ceiling track is connected to the first ceiling anchor member using metal screws.

27. The airloop wall system of claim 21, wherein the second ceiling anchor member is secured to the bottom surface of the second floor slab using masonry fasteners.

28. The airloop wall system of claim 21, wherein the second ceiling track is connected to the second ceiling anchor member using metal screws.

29. The airloop wall system of claim 21, wherein the base track and the ceiling track enable directional positioning adjustment to tolerate construction tolerances.

30. The airloop wall system of claim 21, wherein the airloop window wall system provides a flush exterior surface appearance of a typical curtain wall.

31. The airloop wall system of claim 21, wherein erection of the airloop window wall system requires only interior access.

32. The airloop wall system of claim 21, wherein the first panel and second panel comprise glass, aluminum plate, stone, foam, operable window sash, ventilating louver, or a combination of these.

* * * * *